United States Patent [19]

Arand

[11] 4,035,137

[45] July 12, 1977

[54] BURNER UNIT

[75] Inventor: John K. Arand, Palos Verdes Peninsula, Calif.

[73] Assignee: Forney Engineering Company, Carrollton, Tex.

[21] Appl. No.: 549,272

[22] Filed: Feb. 12, 1975

Related U.S. Application Data

[63] Continuation-in-part of Ser. No. 354,564, April 26, 1973, abandoned.

[51] Int. Cl.[2] ..... F23C 5/10

[52] U.S. Cl. ..... 431/285; 431/174; 431/351

[58] Field of Search ..... 60/39.65; 431/10, 115, 431/174, 178, 175, 181, 190, 283–285, 351–353

[56] References Cited

U.S. PATENT DOCUMENTS

| | | | |
|---|---|---|---|
| 1,910,735 | 5/1933 | Zikesch | 431/352 |
| 2,918,966 | 12/1959 | Ferguson | 431/178 |
| 3,161,228 | 12/1964 | Brodlin | 431/10 |
| 3,273,621 | 9/1966 | Childree | 431/284 |
| 3,306,333 | 2/1967 | Mock | 431/352 |
| 3,306,334 | 2/1967 | Goubsky | 431/352 |
| 3,368,604 | 2/1968 | Mutcher | 431/352 |
| 3,544,246 | 12/1970 | Meyer | 431/352 |
| 3,589,128 | 6/1971 | Sweet | 431/352 |
| 3,608,309 | 9/1971 | Hill | 431/352 |
| 3,743,471 | 7/1973 | Jaeger | 431/115 |

*Primary Examiner*—Carroll B. Dority, Jr.
*Attorney, Agent, or Firm*—Marvin A. Naigur; John E. Wilson

[57] ABSTRACT

A burner unit is provided for receiving gaseous and liquid fuels and generating heat therefrom. The burner unit is formed with a plurality of orifices for introducing combustion air into the burner chamber.

5 Claims, 7 Drawing Figures

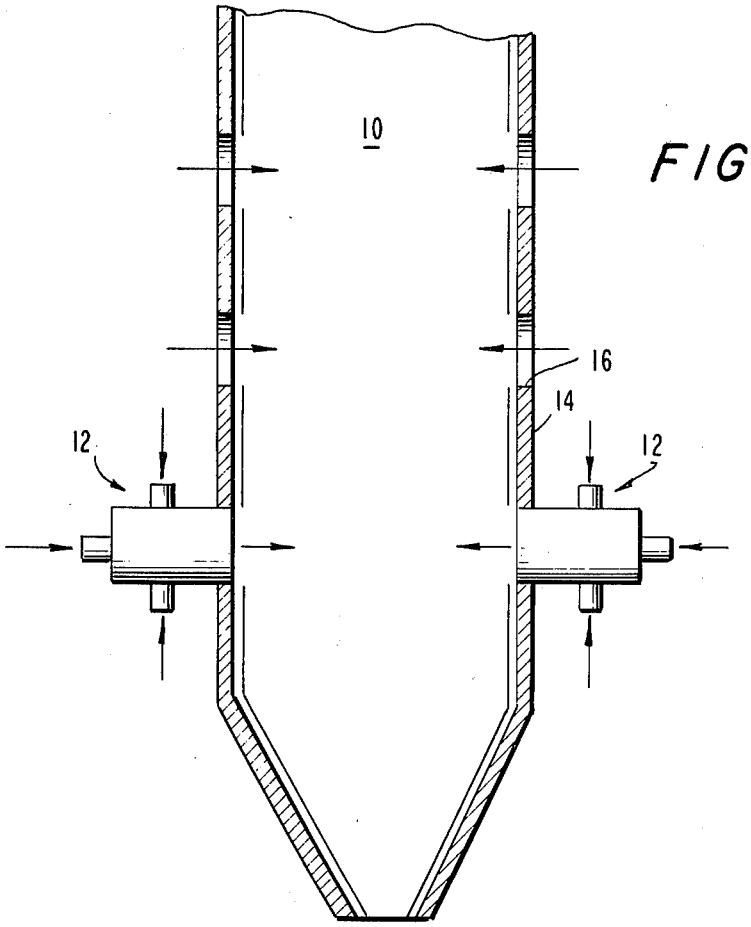
FIG. 1
FIG. 2
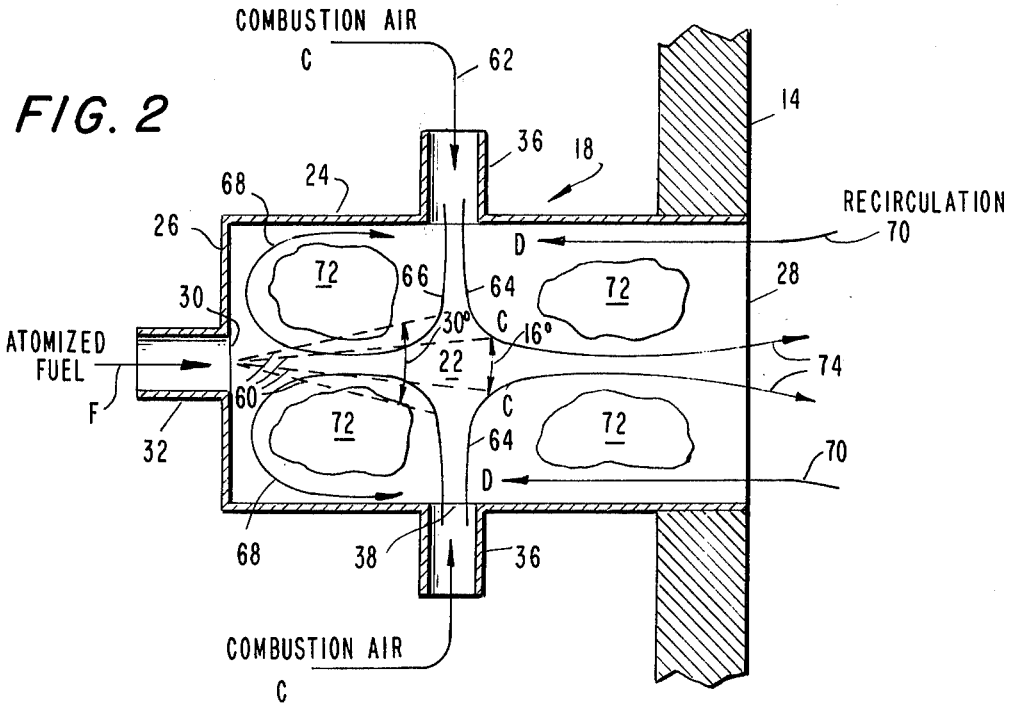

BURNER UNIT

CROSS-REFERENCE TO RELATED APPLICATION

The present application is a continuation-in-part of application Ser. No. 354,564, filed on Apr. 26, 1973 and now abandoned.

BACKGROUND OF THE INVENTION

In the operation of large vapor generators which are used in connection with the production of electrical power, various types of oil and gas burners are utilized. The fuel is usually well mixed with air in and near the burner in order to obtain proper combustion. This generally results in the production of relatively high levels of oxides of nitrogen which are generally referred to as nitric oxides, which cause a severe air pollution problem. Thus, in accordance with the present invention, it is possible to substantially reduce the levels of nitric oxides which heretofore have been produced in prior burner systems. Accordingly, it is possible to meet governmental air pollution requirements for the emission of nitric oxides in vapor generators, by the provision of a primary burner which operates with a fuel-rich mixture with the balance of the air required for combustion being supplied at a secondary location at a suitable distance from the primary burner. It is also possible to utilize the present invention without burning a fuel-rich mixture, and the burner unit of the present invention can be operated with an air-rich mixture for conventional light-off and firing conditions. Thus, the primary objective of the present invention is to provide a simplified system for reducing the levels of nitric oxides produced in large vapor generators. This is achieved by providing a burner cylinder within which it is possible to create recirculation patterns for establishing a near stoichiometric flame stabilization zone in which recirculation gases and atomized oil are injected for combustion, such that the balance of the inected fuel is vaporized and mixed with the incoming air for discharge into the furnace region of the vapor generator where the mixture burns in a non-adiabatic fashion. In this manner, low levels of nitric oxide are achieved together with high levels of combustion efficiency. This results in a condition of superior flame stability in which it is possible to maintain continuous ignition. It should be understood that while the burner unit of the instant invention does have great application for use in vapor generators, applicant's burner also can be used in any variety of furnace uses, such as for example, kilns, drying applications, chemical processes, and fired heaters.

SUMMARY OF THE INVENTION

In accordance with an illustrative embodiment demonstrating features and advantages of the present invention, there is provided a fuel burner assembly for the combustion of oil and/or gaseous fuels comprising an elongated cylindrical wall defining an internal cylindrical burner chamber. An end plate is mounted on the cylindrical wall and has an inlet opening at one end for introducing an atomized spray of fuel into said burner chamber and an exhaust port at the opposite end for exhausting the products of combustion. The cylindrical wall is positioned along a horizontal axis and has a plurality of orifices medially located between the inlet opening and the exhaust port for introducing combustion air into said burner chamber. The injection cylinders are positioned in a plane which is substantially perpendicular to the horizontal axis. Means are provided for supplying jets of air at each of the orifices such that the combustion air is within a range below and above the theoretical combustion air required for complete combustion of the fuel in the burner chamber. In this manner, a portion of the jets of air is circulated towards the inlet opening to mix with a portion of the atomized spray of fuel and thereafter flows along the cylindrical wall towards the exhaust port and the remainder of the jets of air is mixed with the atomized spray of fuel and is conveyed towards said exhaust port for combustion as it is discharged. For the oil burner embodiment, oil nozzle means is provided at the inlet opening coaxially positioned along the horizontal axis and the nozzle means are capable of producing an oil spray angle in the range of from 16° to 30° of the total included angle radially subtending from the horizontal axis. In connection with the combined oil and gas burner embodiment, the end plate is formed with a plurality of gas jet openings equally spaced in a plane along a position coaxial with the horizontal axis of the oil nozzle means.

BRIEF DESCRIPTION OF THE DRAWINGS

The above brief description, as well as further objects, features, and advantages of the present invention will be more fully appreciated by reference to the following detailed description of presently preferred but nonetheless illustrative embodiments in accordance with the present invention, when taken in connection with the accompanying drawings wherein:

FIG. 1 is a front sectional view of the furnace section of a vapor generator in which the burner system of the present invention is mounted;

FIG. 2 is an enlarged sectional view of a first embodiment of the burner assembly of the present invention, which is shown removed from the vapor generator setting of FIG. 1, with the fuel patterns being indicated by the directional arrows;

DESCRIPTION OF THE PREFERRED EMBODIMENTS

Figure 3:
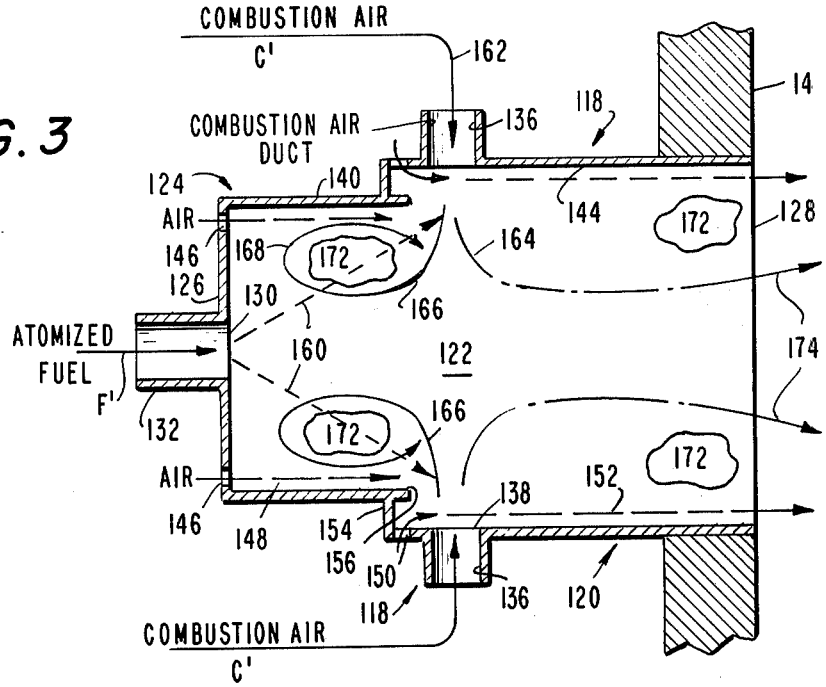
FIG. 3 is an enlarged sectional view similar to FIG. 2, but showing a second embodiment of the burner assembly of the present invention.

I. Low Nitric Oxide Oil Burner Units

Referring now specifically to the drawings, there is shown in FIG. 1 a furnace section 10 of a vapor generator which is provided with a burner system embodying features of the present invention and generally designated by the reference 12. The furnace section 10 is formed from insulated fin-tube walls 14 which have wall orifices 16 for mounting the burner system 12.

The burner system 12 comprises a plurality of individual burner units 18 which are mounted in the wall orifices 16 and usually surrounded by a wind-box structure which is well known in the art and has not been shown in the drawings for the sake of simplicity.

Turning to FIG. 2, the burner unit 18 is formed with an internal chamber 22 which is defined by a cylindrical wall 24 having a rear end plate 26 mounted at one end and a front port opening 28 formed at the opposite end. The rear end plate 26 is provided with a central opening 30 for receiving oil nozzle gun 32 which is coaxially positioned with respect to cylindrical wall 24. Combustion air, which has been designated by reference C, is introduced into internal chamber 22 by means of a series of air injection cylinders 36 that radially extend around cylindrical wall 24. The cylinders 36 are positioned at a suitable median point with respect to the horizontal axis of cylindrical wall 24 which is formed with circular openings 38 for receiving the air injection cylinders 36. It should be understood that the burner system 12 can operate simultaneously with oil and gas fuel or separately with either oil or gas fuel, as will be more fully described in connection with the description of FIG. 5.

The combustion characteristics occurring in the internal chamber 22 are best shown by the flow patterns and zone patterns shown in FIG. 2. Accordingly, atomized fuel designated by the reference letter F and the directional arrows 60 is sprayed into internal chamber 22 through the fuel nozzle 32. The combustion air C is introduced into the internal chamber 22 through the two air injection cylinders 36 shown in FIG. 2. While it is intended to provide at least two air injection cylinders 36 in accordance with the present invention, any number of additional cylinders 36 could be radially mounted along cylindrical wall 24. As shown in FIG. 2, the combustion air C forms a central flow pattern 62 which diverges in internal chamber 22 into a forward flow pattern 64 and a rearward flow pattern 66. The rearward flow pattern 66 mixes with the atomized fuel flow pattern 60 to form recirculation flow pattern 68 which passes in the direction of port opening 28, such that the recirculated flow pattern 68 and front flow pattern 64 pass in countercurrent relationship with recirculation gases from the furnace 10 that are designated by recirculation flow pattern 70. In this manner, the front flow pattern 64, rearward flow pattern 66, recirculated flow pattern 68, and recirculation flow pattern 70 form stable combustion zones 72. In view of the fact that only a portion of the atomized fuel F is burned in the stable combustion zones 72, low levels of nitric oxides are produced, such that the remainder of the atomized fuel from nozzle 32 together with the combustion air C is heated in the stable combustion zones 72 with the flow passing towards the port opening 28. Thus, a pre-vaporized, pre-mixed mixture of fuel F and combustion air C is injected into the furnace 10 as indicated by the directional arrows 74 in order to obtain non-adiabatic combustion.

It should be noted that it is preferably for the combustion air C to comprise 50 to 150 percent of the theoretical combustion air. Also, the rearward flow pattern 66 should ideally consist of from 35 to 50 percent of control flow pattern 62.

In order to more clearly describe and illustrate the advantages of the burner system 12 of the present invention, reference is made to basic burner design and operating parameters in accordance with the following specific example:

EXAMPLE

BASIC BURNER DESIGN AND OPERATING PARAMETERS

TABLE OF TERMS

| | | |
|---|---|---|
| n | = | number of air injection cylinders 36 |
| d | = | diameter of each of the circular openings 38 |
| $\Phi_p$ | = | air fuel ratio corresponding to stoichiometric operation divided by the actual air fuel ratio |
| $D_o$ | = | diameter of cylindrical wall 24 |
| L | = | length of cylindrical wall 24 |
| l | = | distance from centerline of atomized fuel nozzle 132 to circular opening 138 |
| $\Delta P$ | = | pressure drop in internal chamber 22 |

GEOMETRY & $\Delta P$ FOR COMBUSTION AIR SIDE OF INTERNAL CHAMBER 22

$\frac{d}{D_o}$ Range Max. Value .15 - Min. Value .05

$\eta$ 6 to 9

$\Delta P$ (Operating Range) .05 to 30 inches of water $\Delta P$ (Design) 10 inches Ratio distance fuel injector to centerline of holes (0.3 to 0.7)$l/D_o$ Ratio overall length to diameter $\frac{(L)}{D_o}$ .65 1.0

Wall air injection for oil is required

MATERIALS & TEMPERATURES FOR INTERNAL CHAMBER 22

Stainless steel, Hastelloy-X, Inconel, or other high temperature alloys

ATOMIZATION CHARACTERISTICS OF INTERNAL CHAMBER 22

Spray Angle 16° to 30° hollow core
Fuel Pressure 0 to 300 psig
Mechanical, air, or steam atomizers
Fuel - All gaseous and liquid fuels with natural and preheated viscosities up to 300 SUU

GAS INJECTOR

Axial injection with multiple locations so as to provide combination oil and gas simultaneous burning. Axial velocities of injected gas vary from 300 to 1200 fps.

OPERATING CHARACTERISTICS

Cold firing on diesel or preheated residual (heated lines)
Turndown (oil with mechanical atomizer) 4 to 1, (gas) 8 to 1, (oil with steam atomizer) 10 to 1
Operates on cold or preheated air to 900° F
Furnace excess $O_2$ operation up to 15% $O_2$
Fuel-rich operation to $\Phi_p = 3$ on oil and $\Phi_p = 2$ on gas
Low NOx generation in normal operation
Low CO generation in normal operation
Extremely low NOx on gas operation in fuel-rich mode
Low NOx on oil operation in fuel-rich mode
Extremely rapid load changes can be made without loss of flame stability

PREDICTED HEAT LOAD CAPABILITY FOR PRODUCTION MODEL

100,000 to 1,000,000,000 Btu/hr.

PREFERRED CONFIGURATION

$\frac{d}{D_o} = .125$ $\frac{L}{D_o} = .69$ $\eta$ = 6

$\Delta P$ = 9" $H_2O$ (Standard mode at 60% maximum load)
4" $H_2O$ ((Fuel-rich $\Phi_p = 1.15$ at 60% maximum load)

30° Hollow cone spray atomizer

II. DE-COKING BURNER UNITS

In FIG. 3 there is illustrated a further embodiment of the invention in which corresponding parts have been designated by the same reference numerals as part of a "100" series. Also, the corresponding atomized fuel stream and combustion air streams have been designated by the same reference letters as part of a "single prime" series comprising F′ and C′. In this form of the invention, there is provided de-coking burner units 118 each of which is formed with an internal chamber 122 defined by a cylindrical wall 124 having a rear end plate 126 mounted at one end and a front port opening 128 formed at the opposite end. The rear end plate 126 is provided with a central opening 130 for receiving nozzle 132 which is coaxially positioned with respect to cylindrical wall 124. Combustion air, which has been designated by reference C′, is introduced into internal chamber 122 by means of a series of air injection cylinder 136 that radially extend around cylindrical wall 124. The air injection cylinders 136 are positioned at a suitable median point with respect to the horizontal axis of cylindrical wall 124 which is formed with circular openings 138 for receiving the air injection cylinders 136. The cylindrical wall 124 is integrally formed with a reduced cylindrical wall 140 and an enlarged cylindrical wall 144 on which the air injection cylinders 136 are mounted and that terminates with port openings 128.

By inspecting FIG. 3 it can be seen that the rear end plate 126 is formed with a first group of inlet orifices 146 for introducing a primary stream of decoking air 148 along the interior surface of cylindrical wall 140. The enlarged cylindrical wall 144 is formed with a second group of inlet orifices 150 for introducing a secondary stream of de-coking air 152 along the interior surface of enlarged cylindrical wall 144. As shown in FIG. 3, te reduced cylindrical wall 140 is integrally formed with a flange shoulder 154 and a cylindrical lip 156 that overlaps the second group of inlet orifices 150, such that the second stream of de-coking air 152 can pass along the inner surface of enlarged cylindrical wall 144. From the foregoing, it can be appreciated that any coke build-up along the interior surface of cylindrical wall 124, which was formed during the operation of the burner units 118, could be dislodged by means of the primary stream of de-coking air 148 and the secondary stream of de-coking air 152.

The combustion characteristics occurring in the internal chamber 122 are best shown by the flow patterns and zone patterns shown in FIG. 3. Accordingly, atomized fuel designated by the reference numeral F′ and the directional arrows 160 is sprayed into internal chamber 122 through the fuel nozzle 132. The combustion air C′ is introduced into the internal chamber 122 through the two air injection cylinders 136 shown in FIG. 3. While it is intended to provide at least two air injection cylinders 136 in accordance with the present invention, any number of additional cylinders 136 could be radially mounted along cylindrical wall 124. As shown in FIG. 3, the combustion air C′ forms a central flow pattern 162 which diverges in internal chamber 122 into a forward flow pattern 164 and a rearward flow pattern 166. The rearward flow pattern 166 mixes with the atomized fuel flow pattern 160 to form a recirculation flow pattern 168 which passes in the direction of port opening 128, such that the recirculated flow pattern 168 and front flow pattern 164 pass in countercurrent relationship with recirculation gases from the furnace 110 that are designated by directional arrows as recirculation flow pattern 170. In this manner, the front flow pattern 164, rearward flow pattern 166, recirculated flow pattern 168, and recirculation flow pattern 170 form stable combustion zones 172. In view of the fact that only a portion of the atomized fuel F′ is burned in the stable combustion zones 172, low levels of nitric oxides are produced such that the remainder of the atomized fuel from nozzle 132 together with the combustion air C′ is heated in the stable combustion zones 172 with the flow passing towards the port opening 128. Thus, a pre-vaporized, pre-mixed mixture of fuel F′ and combustion air C′ is injected into the furnace 110 as indicated by the directional arrows 174, in order to obtain non-adiabatic combustion.

It should be noted that it is preferable for the combusion air C′ to comprise 50 to 150 percent of the theoretical combustion air. Also, the rearward flow pattern 166 should ideally consist of from 35 to 50 percent of central flow pattern 162.

III. LOW NITRIC OXIDE COMBINED OIL AND GAS BURNER

Figure 5:
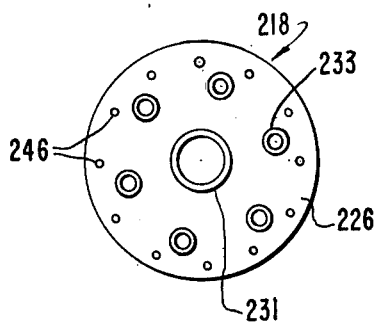
FIG. 5 is an elevational view of the burner assembly shown in FIG. 4, taken along the line 5—5, to show the rear wall air orifices.
Figure 4:
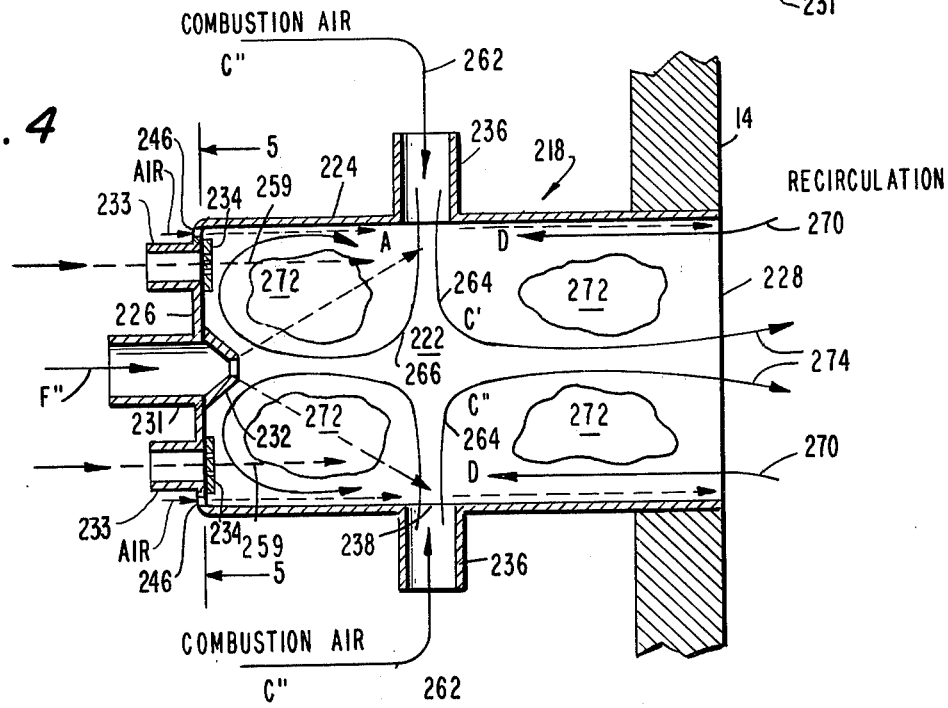
FIG. 4 is an enlarged sectional view similar to FIG. 2 showing a further embodiment of the burner assembly of the present invention.

In FIG. 5 there is illustrated a further embodiment of the invention in which corresponding parts have been designated by the same reference numerals as part of a "200" series. Also, the corresponding atomized fuel stream and combustion air streams have been designated by the same reference letters as part of a "double prime" series comprising F″ and C″. In this form of the invention, there is provided combined oil and gas burner units 218 each of which is formed with an internal chamber 222 defined by a cylindrical wall 224 having a rear end plate 226 mounted at one end and a front port opening 228 formed at the opposite end. The rear end plate 226 is provided with a central opening 230 for receiving oil pipe 231 and oil nozzle 232 which are coaxially positioned with respect to cylindrical wall 224. The end plate 226 is also formed with a plurality of circular openings for receiving gas jet pipes 233 and gas jet nozzles 234 which are equally spaced apart in a position that is coaxial with the horizontal axis of cylindrical wall 224. Combustion air which has been designated by reference C″, is introduced into internal chamber 222 by means of a series of air injection cylinders 236 that radially extend around cylindrical wall 224. The cylinders 236 are positioned at a suitable median point with respect to the horizontal axis of cylindrical wall 224 which is formed with circular openings 238 for receiving the air injection cylinders 236. It should be understood that the burner units 218 can operate simultaneously with oil and gas fuel or separately with either oil or gas fuel. For the purpose of operating the burner units 218 with gas fuel, the number of gas jet openings should correspond to the number of air injection cylinders 236. In this manner, by balancing the gas jet openings 234 and injection cylinders 236, it is possible to maintain maximum flame stability while reducing the formation of nitric oxides. The combustion characteristics occurring in the internal chamber 222 are similar to the flow patterns and zone patterns shown in FIG. 2. As shown in FIGS. 4 and 5, the inlet plate 226 is formed with inlet orifices 246 for introducing a stream of decoking air 248 along the interior surface of cylindrical wall 224. Accordingly, the gas fuel designated by reference letters G and directional arrows 259 and the atomized oil fuel designated by the reference letter F″ and the directional arrows 260 are sprayed into internal chamber 222 through the gas nozzles 234 and the oil nozzles 232, respectively. The combustion air C″ is introduced into the internal chamber 222 through the air injection cylinders 236. In accordance with the preferred embodiment of the combined oil and gas burner 218, it is intended to provide six gas nozzles 234 and six air injection cylinders 236. As shown in FIG. 5, the combustion air C″ forms a central flow pattern 262 which diverges in internal chamber 222 into a forward flow pattern 264 and a rearward flow pattern 266. The rearward flow pattern 266 mixes with the gas fuel flow pattern 254 and the atomized oil fuel flow pattern 260 to form recirculated flow pattern 268 which passes in the direction of port opening 228, such that the recirculated flow pattern 268 and front flow pattern 264 pass in countercurrent relationship with recirculation gases from the furnace 10 that are designated by recirculation flow pattern 270. In this manner, the front flow pattern 264, rearward flow pattern 266, recirculated flow pattern 268, and recirculation flow pattern 270 form stable combustion zones 272. In view of the fact that only a portion of the atomized oil fuel F″ and gas fuel G is burned in the stable combustion zones 272, low levels of nitric oxides are produced, such that the remainder of the atomized fuel from oil nozzle 232 and gas nozzles 234 together with the combustion air C″ are heated in the stable combustion zones 272 with the flow passing towards the port opening 228. Thus, a pre-vaporized, premixed mixture of oil fuel F″ and combustion air C″ is injected into the furnace 10 as indicated by the directional arrows 274 in order to obtain non-adiabatic combustion.

Figure 6:
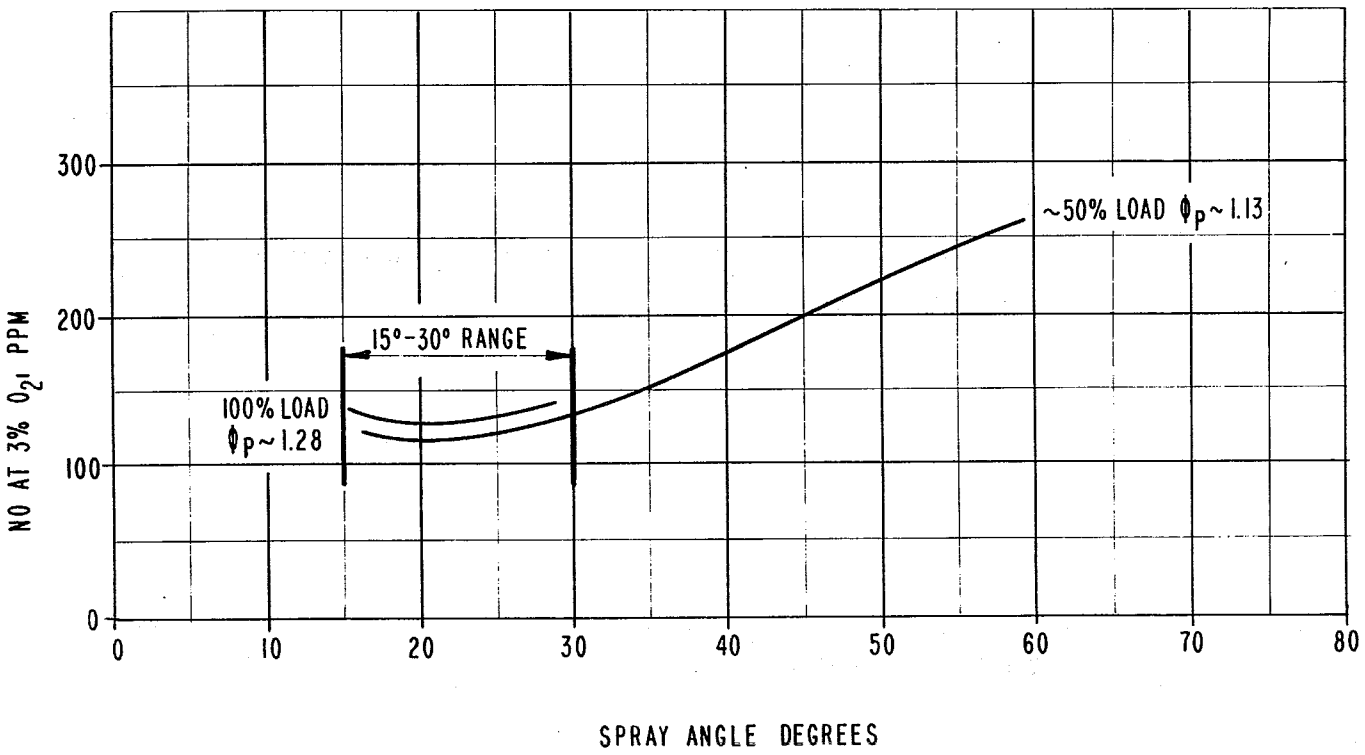
FIG. 6 is a graph of the degree of spray angle versus nitric oxide formation for the burner system operating with oil fuel.
Figure 7:
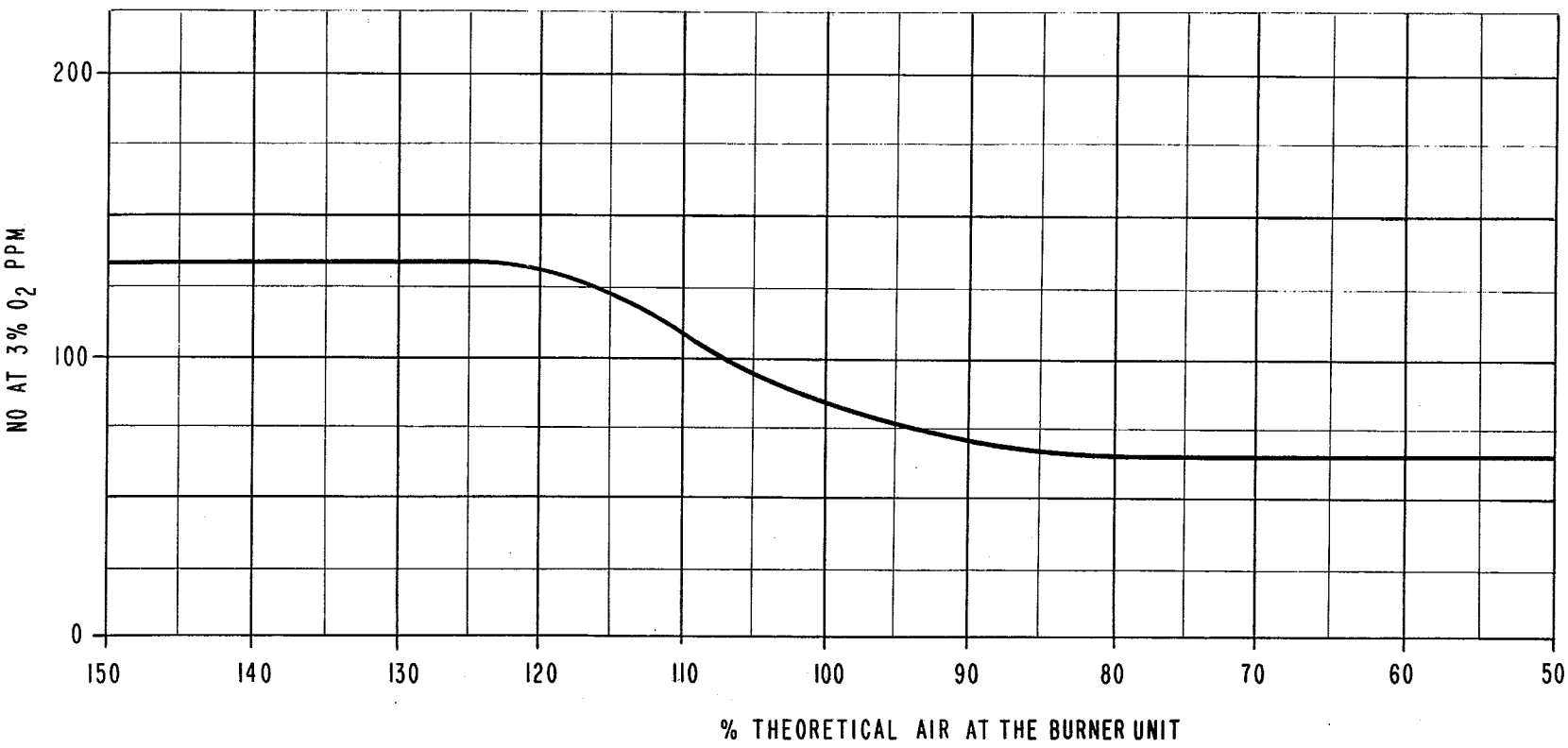
FIG. 7 is a graph showing the percentage of theoretical air versus nitric oxide formation for the burner system operating with gas fuel.

Turning to the graphs of FIGS. 6 and 7, the advantages achieved by applicant's invention, namely, the reduction of nitric oxides in fuel burners, will be more readily apparent. Accordingly, in FIG. 6 it can be seen that by maintaining an oil spray angle in the range of from 16° to 30° of the total included angle radially subtended between the horizontal axis of the burner as shown in FIG. 2, a substantial increase in nitric oxides is prevented. Thus, when the spray angle is greater than 30°, the nitric oxide emissions curve increases greatly.

The 16° to 30° spray angle range results in the achieving of minimum nitric oxide emission, as the curve of the graph in FIG. 6 is relatively flat with the nitric oxide emission being in the neighborhood of 125 parts per million nitric oxide corrected to 3 percent excess oxygen in the flue gas. In this connection, it should be noted that 3 percent excess oxygen in the flue gas is conventional in utility boiler operation.

Turning to FIG. 7, there is shown a graph of percentage theoretical air versus nitric oxide emission for gas fired burner units. Thus, the graph of FIG. 7 shows that a theoretical air combustion range of 50 percent to 150 percent of theoretical combustion air will achieve emissions of below 125 parts per million nitric oxides. In the specification a detailed showing has been presented of the low nitric oxide oil burner units 18 and the low nitric oxide combined oil and gas burner units 218. However, it should be understood that the instant invention also is applicable to low nitric oxide gas burner units. This is achieved by simply eliminating operation of the oil burner section of the combined oil and gas burner units 218. Also, while the decoking burner unit 118 of Section II of the specification has been shown with an oil burner, this embodiment of the invention could likewise be used in combination with only a gas burner or a combined oil and gas burner unit.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A fuel burner assembly for the combustion of liquid and gaseous fuels comprising an elongated cylindrical wall defining an internal cylindrical burner chamber, an end plate mounted on said cylindrical wall having an inlet opening at one end for introducing fuel into said burner chamber and an exhaust port at the opposite end for exhausting the products of combustion, said cylindrical wall being positioned along a horizontal axis, oil nozzle means at said inlet opening coaxially positioned along said horizontal axis, said end plate formed with a plurality of gas jet openings equally spaced apart in a plane such that said gas jet openings are positioned parallel with respect to said horizontal axis, gas nozzles mounted in each of said jet openings, said cylindrical wall having a plurality of orifices equal in number to said gas jet openings and medially located between said inlet opening and said exhaust port for introducing combustion air into said burner chamber, said orifices positioned in a plane which is substantially perpendicular to said horizontal axis, means for supplying jets of air at each of said orifices such that said combustion air is within a range below and above the theoretical combustion air required for complete combustion of the fuel in said burner chamber, whereby a portion of said jets of air is circulated towards said inlet opening to mix with a portion of said fuel and thereafter flow along said cylindrical wall towards said exhaust port and the remainder of said jets of air is mixed with said fuel and is conveyed towards said exhaust port for combustion as it is discharged.

2. A fuel burner assembly according to claim 1 in which said oil nozzle means is capable of producing an oil spray angle in the range of from 16° to 30° of the total included angle radially subtended from said horizontal axis.

3. A fuel burner assembly according to claim 1, in which said means for supplying jets of air forms a central flow pattern of combustion air which diverges into a rearward flow pattern and a forward flow pattern, such that the fuel sprayed from said oil nozzle mixes with said combustion air to form stable combustion zones in which said fuel is burned, whereby low levels of nitric oxides are produced.

4. A fuel burner assembly according to claim 1, in which the end of said burner chamber with said inlet opening is formed with a plurality of through bores for introducing streams of primary air along the internal surface of said cylindrical wall, whereby the formation of coke deposits is prevented.

5. A fuel burner assembly according to claim 1 in which said gas nozzles are equally spaced apart and coaxially positioned around said oil nozzle means.

* * * * *